US006905558B2

(12) United States Patent
Tanaka et al.

(10) Patent No.: US 6,905,558 B2
(45) Date of Patent: Jun. 14, 2005

(54) BILLET BY CONTINUOUS CASTING AND MANUFACTURING METHOD FOR THE SAME

(75) Inventors: Shigenori Tanaka, Kimitsu (JP); Toyoichiro Higashi, Kimitsu (JP); Masahiro Doki, Kimitsu (JP); Jun Fukuda, Kimitsu (JP); Hiroshi Ohba, Kimitsu (JP); Mitsuo Uchimura, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/288,377

(22) Filed: Nov. 6, 2002

(65) Prior Publication Data

US 2003/0070786 A1 Apr. 17, 2003

Related U.S. Application Data

(63) Continuation of application No. 09/623,103, filed as application No. PCT/JP99/07114 on Dec. 17, 1999, now abandoned.

(30) Foreign Application Priority Data

Dec. 28, 1998 (JP) ..... 10-372844

(51) Int. Cl.[7] ..... C22C 38/00; B22D 11/00; B22D 27/02

(52) U.S. Cl. ..... 148/404; 164/468

(58) Field of Search ..... 164/468, 504, 164/499, 147.1; 148/325, 404

(56) References Cited

U.S. PATENT DOCUMENTS

| | | | | |
|---|---|---|---|---|
| 4,030,534 A | | 6/1977 | Ito et al. | 164/504 |
| 4,108,694 A | * | 8/1978 | Shiozaki et al. | 148/308 |
| 4,123,296 A | | 10/1978 | Yamakoshi et al. | 148/333 |
| 4,515,203 A | | 5/1985 | Narita et al. | 164/468 |
| 4,527,615 A | | 7/1985 | Narita et al. | 164/468 |
| 4,567,937 A | | 2/1986 | Ujiie et al. | 164/504 |
| 4,671,335 A | | 6/1987 | Ayata et al. | 164/468 |
| 5,868,875 A | * | 2/1999 | Yoshitake et al. | 148/325 |
| 6,241,004 B1 | * | 6/2001 | Ebisu et al. | 164/466 |
| 6,296,719 B1 | * | 10/2001 | Fortunati et al. | 148/111 |

FOREIGN PATENT DOCUMENTS

| | | | | |
|---|---|---|---|---|
| GB | 2102318 | | 2/1983 | B22D/11/00 |
| JP | 47-033025 | | 11/1972 | B22D/11/00 |
| JP | 62-192242 | * | 8/1987 | B22D/11/128 |
| JP | 7-100608 | | 4/1995 | B22D/11/10 |
| JP | 7-214262 | * | 8/1995 | B22D/11/10 |
| JP | 10-128512 | | 5/1998 | B22D/11/20 |
| JP | 11-010299 | | 1/1999 | B22D/11/128 |
| WO | WO 98/08987 | * | 3/1998 | C21D/8/12 |

* cited by examiner

*Primary Examiner*—Kevin P. Kerns
(74) *Attorney, Agent, or Firm*—Wenderoth, Lind & Ponack, L.L.P.

(57) ABSTRACT

A billet produced by continuous casting having little central segregation, in particular a billet of high carbon steel produced by continuous casting, and a manufacturing method therefor are provided. In the continuous casting billet, the size of the dendritic equiaxed crystal in a billet central portion is reduced to be not more than 6 mm. For this purpose, electromagnetic stirring is performed so that the inclining angle of the primary dendrite within 10 mm of a billet surface layer is increased to be not less than 10°. Furthermore, the mechanical soft reduction is performed during continuous casting so that the diameter of the center porosity in the billet central portion is reduced to be not more than 4 mm. Thereby, in particular in the manufacturing of the continuous casting billet having a carbon content of not less than 0.6% by mass and a billet size of not more than 160 mm can be provided a billet in which breaking troubles in wire drawing after rolling to a rod are reduced by reducing the central segregation in the billet.

3 Claims, 2 Drawing Sheets

BILLET BY CONTINUOUS CASTING AND MANUFACTURING METHOD FOR THE SAME

This application is a Continuation of Ser. No. 09/623,103 filed Aug. 28, 2000, now abandoned, which is a 371 of PCT/JP99/07114 filed Dec. 17, 1999.

BACKGROUND OF THE INVENTION

1. Field of the Invention

The present invention relates to billets by continuous casting, in particular relates to a high carbon steel billet by continuous casting and a manufacturing method therefor by continuous casting, and more specifically it relates to a billet by continuous casting having a small amount of central segregation in its center and a manufacturing method therefor.

2. Description of the Related Art

When bar steel, represented typically by a rod and a bar, is manufactured, a billet in a shape of a square column having a length of one side of no more than 200 mm or a cylindrical column having a diameter of no more than 200 mm is manufactured which in turn is rolled to produce various steel for a bar. When the billet is conventionally manufactured, a bloom having a large cross-section is produced by continuous casting so as to produce the billet by blooming mill. However, it is preferable for simplification of the manufacturing process and promotion of energy saving to produce the billet directly by continuous casting. Therefore, the continuous casting of billets has been carried out mainly for low carbon and medium carbon steel having carbon contents of 0.05 to 0.3% by mass.

The continuous casting of steel involves a problem that impurities in the steel are condensed to be concentrated in the central portion of a cast slab to produce central segregation. When the concentration of the segregation component is large or the range of the central segregation portion is large, in the manufacturing of rod, for example, breaking of wire occurs during wire drawing for producing wire because hardness in the central segregation portion is different from those in other portions. In the case of a cast slab, in the manufacturing of thick plates, for example, a problem that toughness of the central segregation portion in the produced thick-plate is reduced and so forth arises.

The problem of the central segregation arises in producing billets directly by continuous casting just like in slab and bloom. When the carbon content in steel is high, the central segregation has a profound effect on billets. When the high carbon steel billet, as a material, is rolled for producing rod, the central segregation portion of the billet grows to be pro-eutectoid cementite and micro-martensite after rolling of rod, so that cracks originated from the pro-eutectoid cementite and micro-martensite are produced in the rod during wire drawing, resulting in breaking of wire in the rod.

A technique for reducing central segregation in the continuous casting in slab and bloom is known in which an equiaxed crystal rate in the central portion of a cast slab or bloom is increased by reducing the degree of super heat of liquid steel to be poured in a mold. In a billet by continuous casting, reducing the degree of super heat of liquid steel in a mold can also reduce the central segregation thereof. However, the cross-sectional size of a mold in continuous billet casting is small and the internal diameter of a pouring nozzle is also small. Accordingly, when liquid steel having a low degree of super heat is cast, the liquid steel coagulates in the pouring nozzle, so that the nozzle is plugged so as to be susceptible to a trouble of shutting down of casting. Therefore, in continuous billet casting, reducing the degree of super heat of liquid steel is difficult to be adopted as means for reducing the central segregation.

In a slab and a bloom caster, a technique for reducing central segregation is also known in which mechanical soft reduction is carried out with rolls on a cast slab or bloom so as to prevent the liquid steel in the central portion from fluidization by coagulation and contraction to thereby improve the central segregation. When the mechanical soft reduction technique is tried to apply it as it is to the billet, approximate twenty rolls for the mechanical soft reduction are needed to be arranged in the range of approximate 10-m length just like in the slab and the bloom caster. The billet continuous caster has a feature that the number of pinch rolls per one strand is about 5 pairs; however the simplicity in equipment of the billet continuous caster will be lost when a number of the mechanical soft reduction rolls are arranged just like in the slab and the bloom caster.

SUMMARY OF THE INVENTION

Accordingly, it is an object of the present invention to provide billets produced by continuous casting having small amounts of central segregation, and in particular to provide a high-carbon-steel billet produced by continuous casting and a manufacturing method therefor.

In accordance with one aspect of the present invention, there is provided a billet produced by continuous casting having a carbon content of not less than 0.6% by mass, comprising dendritic equiaxed crystals of not more than 6 mm in a central portion of the billet.

In a billet according to the present invention, an inclining angle of a primary dendrite within 10 mm of a surface layer in a section perpendicular to the casting direction may not be less than 10° relative to a direction perpendicular to that of the surface layer.

In a billet according to the present invention, the proportion of equiaxed crystals at the upper hemisection of the billet may not be less than 25%.

In a billet according to the present invention, a diameter of a center porosity in a central portion of the billet may not be more than 4 mm.

In accordance with another aspect of the present invention, there is provided a method for manufacturing a continuous casting billet, comprising the steps of: setting a carbon content to be not less than 0.6%; stirring liquid steel using an electromagnetic stirrer in a mold; so that the size of dendritic equiaxed crystals in a central portion of the billet is not more than 6 mm.

In a method according to the present invention, the proportion of equiaxed crystals in the billet at the upper hemisection is not less than 25%.

In a method according to the present invention, the method may further comprise the step of performing mechanical soft reduction of the billet by arranging a zone of mechanical reduction during continuous casting.

In a method according to the present invention, a value of a solid fraction on a centerline of a cast billet at the exit side of the zone of mechanical reduction may be larger than the solid fraction on a centerline Y expressed by the equation.

$$Y=-0.0111\times X+0.8$$

wherein Y is a lower limit of a solid fraction on the centerline of the cast billet at the exit side of the zone of mechanical reduction (−); and X is the proportion of equiaxed crystals at the upper hemisection (%).

In a method according to the present invention, a total amount of reduction in the step of performing mechanical soft reduction of the billet may not be more than 20 mm.

In a method according to the present invention, a distance from a meniscus in the mold to the exit side of the zone of mechanical soft reduction along a cast billet may be greater than the distance L1 represented by the equation.

$$L1=(-1.38\times X+332.84)\times d^2\times Vc\times 10^{-6}$$

wherein L1 is a lower limit of the distance from the meniscus in the mold to the exit side of the zone of mechanical soft reduction along the cast billet (m);

X is the proportion of equiaxed crystals at the upper hemisection (%);

d is a thickness of the billet (mm); and

Vc is a casting speed (m/min).

In a method according to the present invention, a total amount of reduction in the step of performing mechanical soft reduction of the billet may not be more than 20 mm.

In a method according to the present invention, a distance from the meniscus in the mold to the entrance side of the zone of mechanical soft reduction along the cast billet may be shorter than the distance L2 represented by the equation.

$$L2=d^2\times Vc/4000$$

In the present invention, a billet means a steel block in a shape of a square column having a length of one side of not more than 200 mm or a cylindrical column having a diameter of not more than 200 mm. A billet of continuous casting means a billet directly produced by continuous casting from liquid steel.

In the continuous casting of the billet, when the super heat of liquid steel to be poured in a mold is reduced so as to increase the proportion of equiaxed crystals in the billet central portion, in the region of equiaxed crystals, granular equiaxed crystals are produced. On the other hand, when casting is performed at the ordinary super heat, the proportion of equiaxed crystals in the billet central portion is reduced while the region of equiaxed crystals becomes of a mixed structure of dendritic equiaxed crystals and granular equiaxed crystals. Wherein the dendritic equiaxed crystal means the equiaxed crystal having a dendritic crystal in one equiaxed crystal; the granular equiaxed crystal means the equiaxed crystal having no dendrite.

The size of the dendritic equiaxed crystal is larger than that of the granular equiaxed crystal. In the last stage of solidification, a mushy zone flows toward the front of solidification accompanied by the shrinkage during solidification of a cast billet. When a large dendritic equiaxed crystal exists in a mushy zone, the dendritic equiaxed crystal is restricted to between solidified shells facing each other to produce the phenomenon called bridging. When the dendritic equiaxed crystal produces bridging, a solid phase portion in the mushy zone cannot flow by prevention of the dendritic equiaxed crystal, so that only the component-enriched liquid phase portion moves toward the lower course than the bridged dendritic equiaxed crystal to form a portion in which strong central segregation is produced.

In the present invention, by reducing the size of the dendritic equiaxed crystal contained in equiaxed crystals of a solidified cast billet to be not more than 6 mm, preferably not more than 4 mm, and more preferably not more than 3 mm, the above-mentioned production of bridging is restrained so as to reduce the central segregation in the billet.

As means for reducing the size of the dendritic equiaxed crystal according to the present invention, horizontal stirring of liquid steel in the mold of continuous casting using an electromagnetic force is most effective. Since the object of the present invention is a billet having a small cross-sectional area, it is preferable stirring to rotate liquid steel about a center axis of the billet.

When liquid steel is stirred during solidification, it is known that the direction of a primary dendrite (a columnar crystal) which is one of solidification structures is inclined from the direction perpendicular to the surface of the cast billet. This inclined angle is called an inclining angle. The higher the liquid steel speed by stirring is, the larger the inclining angle becomes.

In the present invention, it is cleared that the larger the inclining angle of the primary dendrite is, the smaller the size of the dendritic equiaxed crystal of the billet becomes. Specifically, by setting stirring intensity of liquid steel so that an inclining angle of the primary dendrite within 10 mm of the surface layer in a section perpendicular to that of casting is to be not less than 15° relative to the direction perpendicular to the surface layer, the size of the dendritic equiaxed crystal contained in equiaxed crystals of a solidified cast billet can be reduced to be not more than 6 mm. The setting of stirring intensity of liquid steel can be performed by adjusting a thrusting force of an electromagnetic stirrer arranged in the mold.

By electromagnetic stirring in the mold, the size of the dendritic equiaxed crystal can be reduced, while the effect for increasing the proportion of equiaxed crystals is also increased. Specifically, by setting stirring intensity of liquid steel so that an inclining angle of the primary dendrite within 10 mm of the surface layer in a section perpendicular to that of casting is to be not less than 10° relative to the direction perpendicular to the surface layer, the proportion of equiaxed crystals at the upper hemisection of the billet can be increased to be not less than 25%; wherein the proportion of equiaxed crystals at the upper hemisection is defined as the value, expressed by the percentage, of the region width of equiaxed crystal existing in the upper side of the billet center divided by one half of the billet thickness.

In continuous casting, shrinkage is produced during proceeding solidification of the cast billet, residual liquid steel flows toward the end of solidification for compensating the shrinkage during solidification, as described above. Since this liquid steel flowing is one of origins of the central segregation of the cast billet by continuous casting, a technique for preventing the liquid steel flowing is known in which the mechanical soft reduction is carried out on the cast billet during proceeding solidification by the amount corresponding to the shrinkage during solidification.

In the present invention, in addition to the above-described invention to reduce the size of the dendritic equiaxed crystal, the central segregation of a billet can be furthermore improved by the mechanical soft reduction by arranging a zone of mechanical reduction during continuous casting. Since liquid steel flowing can be properly prevented when the mechanical soft reduction effective for reducing the central segregation is properly performed, the center porosity of the cast billet can be also reduced. On the contrary, when the center porosities of the cast billet are produced on a higher level than the predetermined one, the improper mechanical soft reduction for reducing the central segregation is indicated. Therefore, by estimating production of the center porosities of the cast billet, the central segregation improvement by the mechanical soft reduction according to the present invention can be confirmed.

Specifically, when the center porosity on a vertical surface including the center line over the length of 500 mm in the casting direction in the cast billet after casting is measured, if the maximum diameter of the measured center porosity is not more than 4 mm, improving of central segregation by the mechanical soft reduction according to the present invention is confirmed to be effective.

DESCRIPTION OF THE PREFERRED EMBODIMENT

Figure 1:
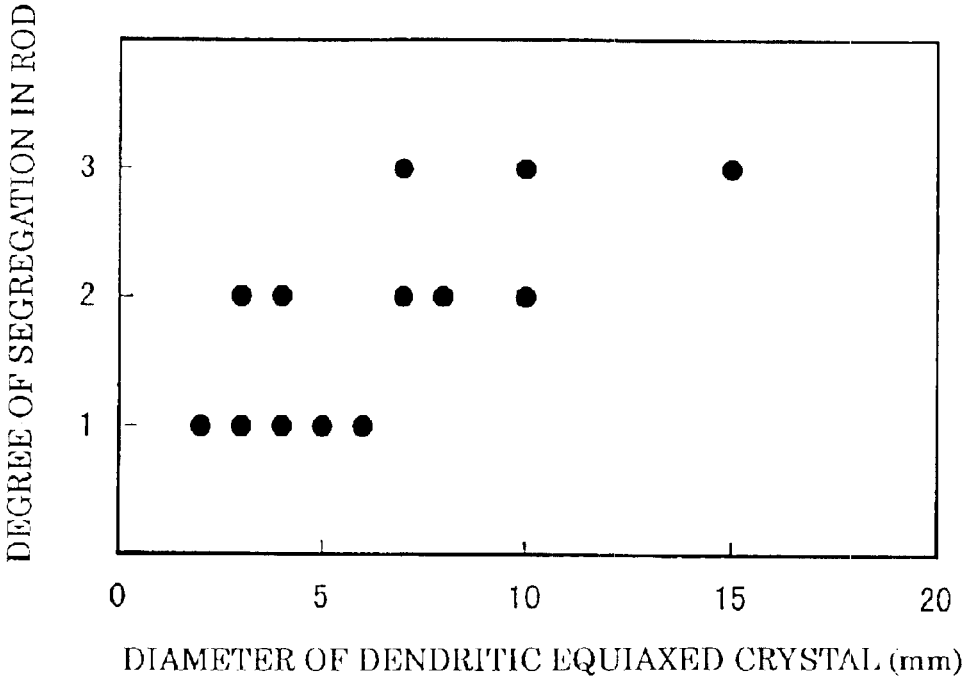
FIG. 1 is a graph showing relationship between diameters of dendritic equiaxed crystal in a billet and degrees of segregation in rod.

First, the inventor in detail surveyed locations of breaking in a billet and rod during wire drawing when the billet produced by continuous casting is rod-rolled and is further wire-drawn. From findings, when a cross-section of the rod is eroded by nital to become black in the central portion thereof, it is apparent that breaking possibilities are high if the degree of becoming black is great. Therefore, black degrees in the central portions of cross-sections of the rod, and segregation forms and concentrations of segregation components collected in advance from vicinities of evaluated positions of the rod are analyzed.

When a section of the billet parallel to the longitudinal direction thereof is etched, segregation spots can be seen in a central segregation portion in the billet central portion. It is understood that in the billet collected from the position adjacent to the rod portion in which the rod cross-section eroded by nital becomes black in the central portion thereof, granular diameters of segregation spots in the billet section are large and a number of segregation spots accumulate as well, while in the billet collected from the position adjacent to the portion in which the rod cross-section does not become so black in the central portion thereof, granular diameters of segregation spots in the billet section be small and the segregation spots be dispersed one another as well. On the other hand, segregation components in the segregation spot portion of the billet, the maximum segregation concentrations of P and Mn for example, are found to be roughly constant regardless of granular diameters of segregation spots.

Reasons for obtaining the above-mentioned results are estimated: when segregation spots of the billet are dispersed, it is not seen to be black by accumulation because it is eroded in a state of dispersion; on the other hand, when segregation spot portions are accumulated while not being dispersed, eroded portions in the rod are accumulated to be seen as black with naked eyes.

In this manner, in a place where the segregation spots range in the billet, it is considered that the portion in which the hardness is high (P segregation portion) and the portion where cementite and martensite are formed (Mn segregation portion) also range in the rod, so that the rod breaking occur by propagation of a crack during wire drawing of the rod. On the other hand, when segregation spots exist in a dispersed state even in a central segregation portion of the billet, it is considered that propagation of a crack does not take place to breaking even when the segregation concentration is identical with the above-mentioned portion where the segregation spots range. When segregation spots exist in a dispersed state in the billet, since black portions are a few in the corresponding eroded section of the rod, component dispersion exists during rolling of the rod although in small amounts, so that it is possible that the component dispersion is more activated when segregation spots are dispersed.

Next, factors to reduce the diameter of the segregation spot of the cast billet and disperse the spots as well are investigated.

In the billet produced by continuous casting, except by casting at especially low liquid steel super heat, both the dendritic equiaxed crystal and the granular equiaxed crystal exist in an equiaxed crystal region as described above and when a conventional casting method is adopted, the size of the dendritic equiaxed crystal is large. In a solidification structure of the billet, it is found that when the size of the dendritic equiaxed crystal is small, diameters of the segregation spots of the billet are reduced and a dispersed state is obtained as well.

Reasons that the diameter of the segregation spot is reduced and a dispersed state is obtained as well by the reduced size of the dendritic equiaxed crystal of the billet are discussed. In the last stage of solidification, equiaxed crystal grains organize a network by connecting to one another. From results of the study of the inventors by making a three-dimensional mathematical model, it is cleared that when the equiaxed crystal diameter is large, bridging between the equiaxed crystal grains network and a solidified shell are prone to be formed, so that V-segregates be likely produced in the equiaxed crystal region, while when the equiaxed crystal diameter is small, the volume of the portion surrounded by the equiaxed crystal become little, so that the segregation spot diameter be reduced and the spots be prone to be dispersed.

When the equiaxed crystal diameter is small, about 3.5 mm, such the network is completed when the proportion of the equiaxed crystals becomes about 0.8, while when the equiaxed crystal diameter is large, about 7 mm, and even when the proportion of the equiaxed crystals is about 0.8, the probability of the network of not being completed is 10%, so that the segregation spots are considered to become larger in a state of ranging in a row.

As described above, the inventor has found that in the continuous casting of the billet, reduction of the size of the dendritic equiaxed crystal is important for preventing the rod from breaking. In addition, when the equiaxed crystal diameter is measured during the inspection in the cast billet stage, a preestimate of the breaking of the rod becomes possible.

FIG. 1 shows relationship between diameters of dendritic equiaxed crystal in a billet and degrees of segregation in the rod. Wherein the degrees of segregation are defined below as:

Segregation degree 1: no strong segregation in rod and no pro-eutectoid ferrite/micro-martensite.

Segregation degree 2: with strong segregation in rod and pro-eutectoid ferrite/micro-martensite produced.

Segregation degree 3: with strong segregation in rod and pro-eutectoid ferrite/micro-martensite much produced. It is clear that the degree of segregation in rod is low and production of granular cementite/micro-martensite be reduced, when the dendritic equiaxed crystal diameter is no more than 6 mm, preferably no more than 4 mm, and more preferably no more than 3 mm. In addition, the data shown in FIG. 1 are results from continuous casting of a billet having a billet size of 122 mm at liquid steel super heat temperatures in a tundish of 20 to 40° C. Similar results can be obtained in a billet having lengths of one side up to 160 mm.

The measuring procedures for obtaining the dendritic equiaxed crystal diameter according to the present invention are as follows:

Samples are picked up from an arbitrary longitudinal portion of a cast billet. Generally samples are picked up from the end portion of the billet after cutting it off in a suitable length for rod rolling. In the sample, the section of the billet being parallel to the casting direction and passing through the billet center as well is mirror-polished and the solidification structure is developed therefrom by etchant such as picric acid. Furthermore, a print may be taken as follows: etched holes formed by segregation etching using etchant are filled with fine re-polishing powder so as to be transferred to transparent adhesive tape (an etching print method). The maximum size of the dendritic equiaxed crystal among sizes thereof existing in the cast billet center portion in the longitudinal range of 500 mm thereof is measured using the etching surface or the printed surface from the above-mentioned cast billet samples; wherein the cast billet center portion is defined as a region within vertical ±10 mm relative to a center line in which segregation spots range in the vicinity of the cast billet center. And the size of, the dendritic equiaxed crystal may be preferably measured by magnifying it by about five times using a magnifying glass.

As a prior condition for applying the present invention, the billet containing carbon of no less than 0.6% by mass which will likely produce defects originated by segregation in products is to be object thereof.

The present invention is especially useful to the billet having lengths of one side or diameters of no more than 160 mm. Three reasons therefor are as follows:

First, the less one-side-length is, i.e., the less the cross-sectional area is, the shorter the time for solidification from formation of the equiaxed crystal in a mold becomes. That is, the less one-side-length is, the higher the cooling speed becomes, so that a core of the equiaxed crystal formed in the mold grows in a shape having prickles to be prone to remain therein as the dendritic equiaxed crystal. The maximum one-side-length of a cast billet therefor is about 160 mm.

Second, the less one-side-length is, the smaller the amount of bulging becomes. Accordingly, complicated equipment for reducing a clearance between rolls, cooling between rolls, and so forth like in a bloom continuous caster is not needed, so that mechanical soft reduction equipment can be applied to the continuous caster with a simplified structure of rolls having a small number of rolls. The maximum one-side-length of a cast billet therefor is about 160 mm.

Third, in a practical point, the maximum billet size to eliminate the blooming process is about 160 mm, and in the sizes more than this size, the process called as blooming for reducing the size is needed between the casting and rolling to rod. The maximum billet size to eliminate the blooming process is about 160 mm.

Then, a method for reducing the granular diameter of the dendritic equiaxed crystal in the billet central portion within the range according to the present invention will be described. The inventors found that stirring of liquid steel in a continuous casting mold in the horizontal directions using an electromagnetic force is effective in reducing the size of the dendritic equiaxed crystal. Since the billet according to the present invention is in a shape of a square column or a cylindrical column having a small cross-section, as the flow of stirring in the horizontal directions, the rotational flow about the billet center is most preferable. As an electromagnetic stirrer for stirring liquid steel in a mold, the same electromagnetic stirrer as the one used generally for a bloom continuous caster can be used.

The liquid steel speed in the horizontal direction in the portion contacting a solidified shell in a mold can be estimated by measuring the inclining angle of primary dendrite (columnar crystal), being one of solidification structures, as shown in conventional technical literature. The inclining angle of the primary dendrite is defined as an inclining angle between the direction of the primary dendrite within 10 mm of the surface layer in a section perpendicular to the casting direction and the direction perpendicular to the surface layer. It is shown that the larger this inclining angle is, the higher the liquid steel speed becomes. The stronger the driving force of the electromagnetic stirrer is, the higher the liquid steel speed can be raised to, so that the inclining angle of the primary dendrite is increased.

The method for measuring the inclining angle of the primary dendrite is as follows:

After picking up four samples having a thickness of about 10 mm from the surface layer of the central portion in the width and the thickness direction of the billet in a section in the direction perpendicular to that of casting. The solidification structure is developed by polishing and etching by etchant such as picric acid and a picture magnified by five to ten times is taken. Two lines on the picture are drawn parallel to the surface layer separated from the surface layer by 2 and 4 mm depth, respectively (10 and 20 mm depth on the five times picture). Perpendicular lines to the base lines are drawn on the base lines at 1 mm intervals (at 5 mm intervals on the five times picture). The maximum angle of the dendrite among inclining angles (angles between the dendrite and the direction perpendicular to the surface layer) of primary dendrites observed on the base lines surrounded by the base line and the perpendiculars is measured. Angles of respective 20 points of 2 and 4 mm depths are measured for each sample; calculate the average values of respective 2 and 4 mm depths and the higher value of them is taken as the angle of the primary dendrite of the sample; and the angle of the primary dendrite of the section is defined by the average value (the arithmetical mean) of inclining angles of the primary dendrites of four samples taken from the section.

The inventors have found that in the billet produced by continuous casting chosen as the object of the present invention, the larger the inclining angle of the primary dendrite is, the smaller the size of dendritic equiaxed crystal becomes. Therefore, estimation of the size of dendritic equiaxed crystal is also possible by measuring the inclining angle of the primary dendrite.

Figure 2:
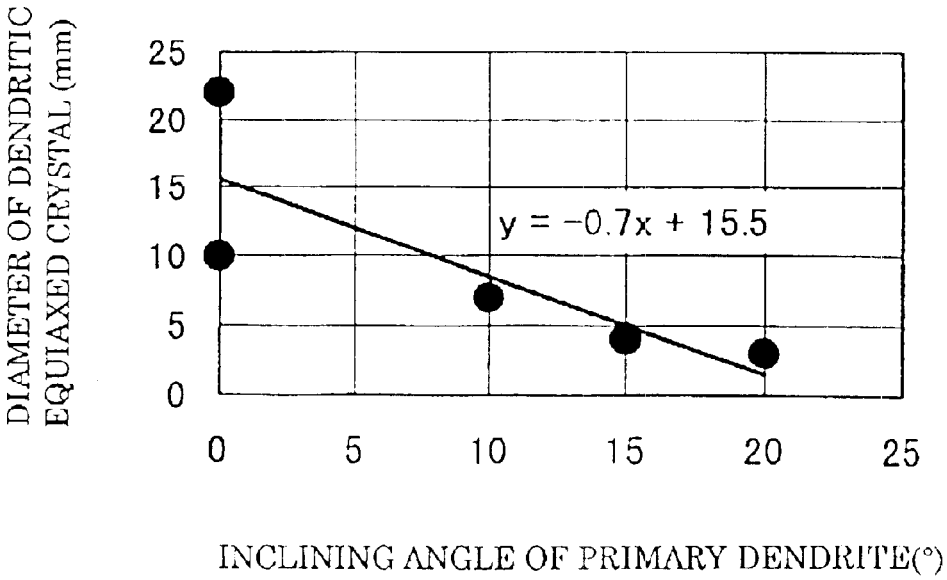
FIG. 2 is a graph showing relationship between inclining angles of the primary dendrite within 10 mm of the surface layer in a section perpendicular to that of billet casting relative to the direction perpendicular to the surface layer and diameters of dendritic equiaxed crystal in a billet.

FIG. 2 shows the relationship between inclining angles of the primary dendrite of the billet having one-side-lengths of 120 to 130 mm and sizes of dendritic equiaxed crystal. The size of dendritic equiaxed crystal in the center portion of the cast billet can be no more than 6 mm by increasing the inclining angle of the primary dendrite to no less than 10°. Furthermore, when the inclining angle of the primary dendrite is to be no less than 15°, the size of dendritic equiaxed crystal can be no more than 4 mm; and when the inclining angle of the primary dendrite is to be no less than 20°, the size of dendritic equiaxed crystal can be no more than 3 mm. In addition, although the examples in the billet having one-side-lengths of 120 to 130 mm are shown in FIG. 2, the same results can be obtained as long as for the billet having one-side-lengths of no more than 160 mm.

In order to reduce the central segregation by granular equiaxed crystallizing of the central structure of the billet, it was needed to reduce the super heat of liquid steel for pouring into a mold. However, in the present invention in which the central segregation is reduced by reducing the size of dendritic equiaxed crystal in the central portion of the billet, it is not needed to reduce the super heat of liquid steel. The super heat of liquid steel in a tundish just before pouring into a mold may be in the range of 20 to 40° C. just like in the ordinary casting.

The reasons of reduction in the size of dendritic equiaxed crystal by electromagnetic stirring in the horizontal directions in a mold can be estimated as follows:

On the surface of a solidified shell contacting the liquid steel, concentrations of segregating components in both the solidified shell and the liquid steel are reduced by washing in stirring to thereby increase the solidification temperature of the liquid steel, resulting in reducing the temperature difference between the liquid steel and the interface. Thereby, the solidification is prone to occur not only in the interface between solid and liquid but also within the liquid steel so as to increase the number of equiaxed crystal grains by forming a number of embryos of solidification, so that the diameter of equiaxed crystal is considered to be reduced.

It is also well known that the dendrite crystal grows upstream in the liquid steel flow. The reason thereof is described that the dendrite crystal inclines because in the side of the dendrite crystal column striking the liquid steel, the temperature gradient and the concentration gradient are increased compared to those in the opposite side so as to promote the solidification. However, since the heat extracting direction from the surface of the cast billet is perpendicular to the thickness of the solidified shell, for the thermal balance, the stagnating regions of flow and temperature are formed downstream from the dendrite crystal column inclining upstream in a state to be prone to form equiaxed crystal in a microscopic point of view. In this manner, there is a strong possibility that growing itself of the inclining dendrite crystal has a direct effect on formation of equiaxed crystal.

When super heat of liquid steel is high, the temperature of the residual liquid steel is reduced by electromagnetic stirring in a mold. Consequently, a large number of embryos of solidification grow to be dendritic equiaxed crystal and granular equiaxed crystal, so that each size of the dendritic equiaxed crystal is reduced.

The surface area of the billet is larger relative to the volume of liquid steel in comparison with bloom or slab, so that the heat extraction rate from the surface is large, which is also effective for preserving the formed equiaxed crystal as it is without re-dissolution. When the shape of equiaxed crystal in the cast billet is practically observed, there is dendritic-shaped crystal which is so-called dendritic equiaxed crystal being different from granular equiaxed crystal formed by electromagnetic stirring in the conventional slab caster. This indicates that in the billet, the formed equiaxed crystal remains until the terminal solidification position without re-dissolution or it grows during solidification. In the view of easiness of forming the above-mentioned network by equiaxed crystal, the shape having dendrites is considered to be advantageous.

Figure 3:
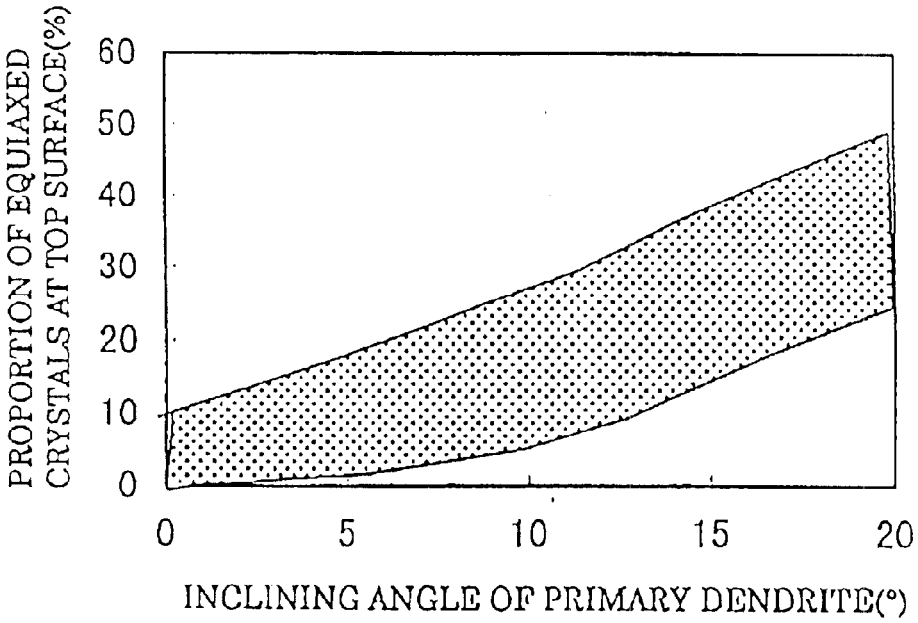
FIG. 3 is a graph showing relationship between inclining angles of primary dendrite in a billet and the proportions of equiaxed crystals in the upper hemisection.

In the present invention, liquid steel in a mold is stirred using an electromagnetic force for the purpose of reducing the size of dendritic equiaxed crystal. Consequently, the proportion of equiaxed crystals of the billet can be also increased. FIG. 3 shows the relationship between inclining angles of primary dendrite and the proportions of equiaxed crystals in the upper hemisection. In FIG. 3, the results from the billet with a billet size of 122 mm produced by continuous casting are shown and all the super heat temperatures of liquid steel in a tundish were 20 to 40° C. The same results can be obtained as long as for the billet having one-side-lengths of no more than 160 mm. The proportion of equiaxed crystals in the upper hemisection of the billet can be no less than 25% by setting the stirring intensity of liquid steel so as to increase the inclining angle of the primary dendrite within 10 mm of the surface layer in a section perpendicular to the casting direction relative to the direction perpendicular to the surface layer to be no less than 10°. Wherein the proportion of equiaxed crystals in the upper hemisection is defined as the value, expressed by the percentage, of the region width of equiaxed crystal existing in the upper side of the billet center divided by one half of the billet thickness.

Furthermore, in the present invention, in addition to reducing the size of dendritic equiaxed crystal as described above, carrying out the mechanical soft reduction on the billet in the last stage of solidification is also effective for reducing the central segregation because it prevents V-segregates to disperse segregating grains. The mechanical soft reduction is carried out by mechanically reducing the cast billet in the region of unsolidified liquid steel in a mushy zone in continuous casting of the billet using no less than one pair of rolls. When the mechanical soft reduction is carried out by forming a zone of mechanical reduction using plural pairs of rolls, the pairs of rolls are preferably arranged over the length of the zone of mechanical reduction at no more than 350 mm intervals and the mechanical reduction is performed by setting the amount of reduction of the cast billet for each of pairs of rolls.

When the mechanical soft reduction is carried out on the preferred casting portion, while the central segregation of the billet can be reduced, production of center porosity in the central portion of the billet can be also reduced. Therefore, when the center porosity on a vertical surface including the center line over the length of 500 mm in the casting direction in the cast billet after casting is measured, as described above, if the maximum diameter of the measured center porosity is no more than 4 mm, improving of central segregation by the mechanical soft reduction according to the present invention is confirmed to be effective.

On the other hand, when the flow of the liquid steel does not take place, the solidification structure included only columnar crystal having no equiaxed crystal. In this case, even if the mechanical soft reduction was carried out, the center porosity was not reduced having a large diameter of 11 mm. The reason for that is considered that when the flow of the liquid steel does not take place, the solidified shell produces bridging in the extremely early stage prior the zone of mechanical reduction, so that the center porosity is produced before entering the zone of mechanical reduction.

The billet caster has a feature of having a small number of rolls as described above. In contrast, in order to reduce the segregation when the solidification having only columnar crystal takes place, a long zone of mechanical reduction is needed just as in the slab continuous caster. In the billet continuous caster, arranging such the long zone of mechanical reduction opposes the above-mentioned feature of the billet continuous caster to be uneconomical.

In the solidification structure having equiaxed crystal in the center portion thereof, generation of bridging is delayed even in the portion having a high solid fraction. Then even if the mechanical soft reduction is started from a high solid fraction, it is effective. Even when the central solidification structure is formed of equiaxed crystal, the center porosity is reduced compared with the structure having only columnar crystal. By the way, when the central solidification structure was formed of equiaxed crystal and the mechanical soft reduction was not carried out, the size of the center porosity was about 6 mm.

When the casting portion on which mechanical soft reduction is to be carried out is discussed, the solid fraction on the centerline of a cast billet can be used as an index. The reason therefor is that the period when enriched liquid steel starts to accumulate between dendra and so forth of dendrite crystal in a mushy zone is estimated as a solidification period in which the passing resistance of liquid steel in the center portion of the cast billet increases, so that the solid fraction on the centerline is considered to have the most important effect on the passing resistance of liquid steel. That is, the solid fraction on the centerline is considered as the most appropriate index indicating a solidification period of central segregation generation.

When the solid fraction on centerline in the entrance side of the zone of mechanical reduction is fixed, effects of the solidification structure and the solid fraction on centerline in the exit side of the zone of mechanical reduction on the central segregation are studied. As a result, it is found that the higher the proportion of equiaxed crystals in the upper hemisection in the cast billet is, the lower the solid fraction on centerline in the exit side of the zone of mechanical reduction is able to, keeping the central segregation improved. That is, when the proportion of equiaxed crystals in the upper hemisection is high, the central segregation is improved even in a short zone of soft reduction. The reason therefor is estimated as that the increase of the proportion of equiaxed crystals in the upper hemisection restrains the flow of enriched liquid steel existing between equiaxed crystals so that accumulation of enriched liquid steel due to shrinkage during solidification is prevented.

The relationship between the proportion of equiaxed crystals in the upper hemisection and the solid fraction on centerline in the exit side of the zone of mechanical reduction (lower limit) is expressed in the following equation (1). Therefore, the effect according to the present invention can be obtained by increasing the solid fraction on centerline in the exit side of the zone of mechanical reduction to be larger than the following "Y" value.

$$Y=-0.0111\times X+0.8 \quad (1)$$

wherein "Y" is the solid fraction on centerline of the cast billet in the exit side of the zone of mechanical reduction (–);

"X" is the proportion of equiaxed crystals in the upper hemisection (%).

As described above, the length of the zone of mechanical reduction is designed to be short in combination with the casting conditions enabling to maintain the proportion of equiaxed crystals in the upper hemisection in a high value, so that equipment cost for mechanical soft reduction can be reduced. In the present invention, the electromagnetic stirring is carried out in order to reduce the size of dendritic equiaxed crystal, and consequently, the proportion of equiaxed crystals in the upper hemisection can be in a high value, enabling to reduce the length of the zone of mechanical reduction.

In addition, by using a calculated value estimated from the thermal transmission calculation combined by the surface temperature of the cast billet by the inventors as a value of the solid fraction on centerline, it is found that the effect on reduction of the central segregation by the mechanical soft reduction is furthermore increased even when the solid fraction on centerline in the exit side of the zone of mechanical reduction is to be no less than 0.7. On the other hand, an obtained calculated result is that using the above-mentioned three-dimensional mathematical model, V-segregates are formed in the proportion of equiaxed crystals of about 0.8, that is, the network of equiaxed crystal is formed at the solid fraction of about 0.8. That is to say, the fact that the effect on reduction of the central segregation is increased even when the solid fraction on centerline in the exit side of the zone of mechanical reduction is to be no less than 0.7 corresponds to this calculated result and the solid reduction even at high solid fraction produces the effect on reduction of the central segregation. It is considered that the effect is rather improved by mechanical reduction at high solid fraction.

The effect of the present invention can be obtained by instructing the solid fraction on centerline of the cast billet in the exit side of the zone of mechanical reduction as described above. Furthermore, the more preferable effect can be obtained by arranging the entrance side of the zone of mechanical reduction in the upper course than the portion having the solid fraction on centerline of 0.3, and more preferably the solid fraction on centerline of 0.2. The reason that the central segregation is furthermore improved by instructing the solid fraction on centerline of the cast billet in the entrance side of the zone of mechanical reduction can be considered as follows. When the solid fraction on centerline is increased to be about no less than 0.3, the flow in the mushy zone is restrained to be difficult to move and island portions of residual liquid phase portions to be segregated start to be formed. Accordingly, by mechanical reduction of the lower course side than these portions, the flow of the residual liquid steel can be restrained so as to prevent the residual liquid steel from cohering among themselves.

On the other hand, when the zone of mechanical reduction is arranged to satisfy the solid fraction on centerline in the entrance side of the zone of mechanical reduction to be 0.2 to 0.3 while the solid fraction on centerline of the cast billet in the exit side of the zone of mechanical reduction expressed in the equation (1) is satisfied, the length of the zone of mechanical reduction is to long enough, 8 to 10 m.

However, in the practical billet continuous caster, three to four pairs of pinch rolls are arranged, to thereby reduce the region just having the solid fraction on centerline of 0.2 to 0.3 to some degree. It is considered that the preventing effect on the flow of liquid steel even by these pinch rolls is effective from the region having the solid fraction on centerline of 0.2 to 0.3 to the region of 0.4 to 0.5. Therefore, the zone of pinch rolls can be considered to be included in the zone of mechanical reduction, so that the solid fraction on centerline in the entrance side of the zone of mechanical reduction can be 0.2 to 0.3. On the other hand, the most important portion for controlling segregation is the portion in which the network is frequently formed, that is the portion having the solid fraction on centerline of over 0.4 to 0.5. Therefore, in this important portion, several pairs of exclusive rolls for mechanical soft reduction other than the existing pinch rolls are densely arranged, so that the effect of mechanical soft reduction according to the present invention can be thoroughly realized. In this manner, by joint use of pinch rolls for mechanical soft reduction, the length of the newly built zone of mechanical soft reduction can be reduced, resulting in reduction in equipment cost.

The amount of reduction in the zone of mechanical soft reduction is enough when shrinkage during solidification of the cast billet can be compensated. When the spacing of adjoining mechanical soft reduction rolls is 350 mm, the amount of reduction for each roll of 1.5 to 3 mm is most suitable. When the amount of reduction is insufficient, V-segregates of the cast billet do not disappear sufficiently while when the amount of reduction exceeds the amount of shrinkage during solidification, inverse V-segregates are produced. Therefore, the most suitable amount of reduction is decided for each continuous caster by confirming segregating situations of the cast billets.

The suitable amount of reduction for each roll in the zone of mechanical soft reduction for steel having strong sensibility to crack will be described. The suitable amount of reduction for each roll also depends on the thickness of the solidified shell during reduction: for example, for the thickness of the solidified shell of no less than 30 mm, the suitable amount of reduction is no more than about 4.5 mm; when the amount of reduction exceeds 4.5 mm, in the steel having strong sensibility to crack, cracks in the solidification interface are possibly produced during reduction; and this does not apply to the steel having ordinary sensibility to crack.

The reason for instructing the total amount of reduction during mechanical soft reduction to be no more than 20 mm is that by the excessive reduction of over this value, enriched liquid steel flows backward to produce inverse V-segregates to deteriorate segregation. In addition, the total amount of reduction of no more than 20 mm is the suitable range for the billet size of 122 mm and when the billet size exceeds 122 mm, the suitable range of the total amount of reduction is also extended upwardly.

The minimum of the total amount of reduction is to be about 5 mm for the billet size of 122 mm, when the effect of the mechanical soft reduction is obtained. When it is to be over about 5 mm, the flow of enriched liquid steel can be prevented by restraining the shrinkage during solidification. This value is considered to increase in proportion to the billet size.

According to the present invention, the solid fraction on centerline can be obtained as follows:

The solid fraction of the cast billet in the thickness center portion is ordinarily calculated from the temperature of the cast billet center portion calculated by the thermal transmission calculation. According to knowledge of the inventors, the solid fraction of the cast billet in the thickness center portion is a value physically determined by the cooling conditions, components of steel, and the time needed by the cast billet for moving from the mold to the reduction roll. Therefore, when the cooling conditions and components of steel are to be constant, the solid fraction is calculated based on the temperature of the cast billet center portion determined only by the time needed by the cast billet for moving from the meniscus in the mold to the reduction roll.

Figure 4:
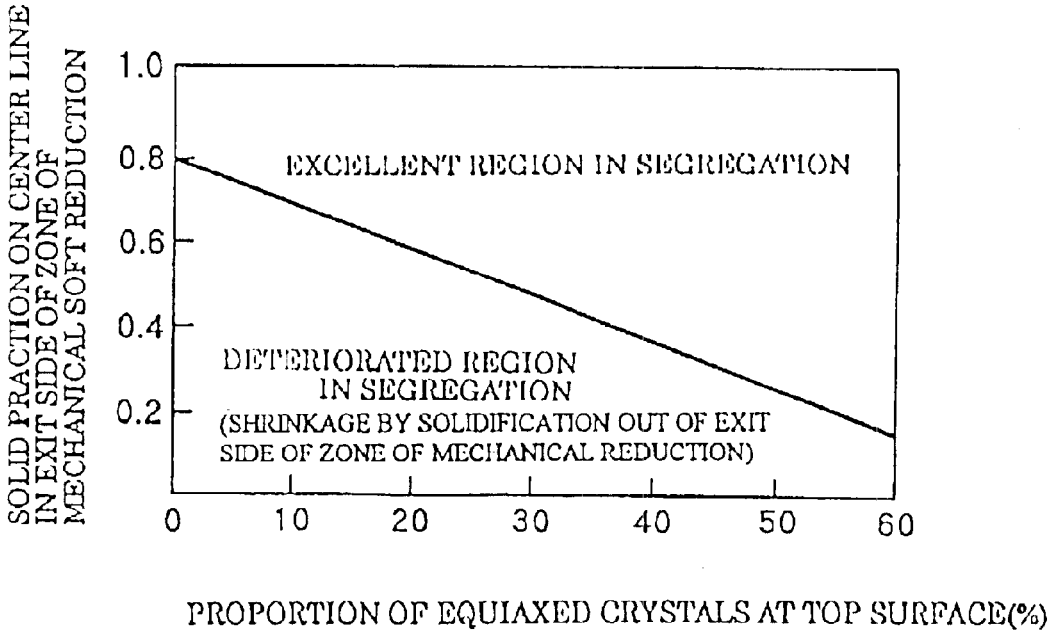
FIG. 4 is a graph showing effects on degrees of central segregation by the proportions of equiaxed crystals in a billet in the upper hemisection and solid fractions on center line in a billet in a zone of mechanical reduction.

The temperature of the cast billet center portion can be obtained by the thermal transmission calculation of the cast billet. The heat transfer coefficient of the cast billet surface by spray cooling is determined by known literature. Then the temperature distribution within the cast billet is obtained by the thermal transmission calculation to get the surface temperature of the cast billet and the temperature in the center portion thereof. The temperature of the cast billet center portion can be also calculated identically to the real temperature by combination of the results of the thermal transmission calculation with actual results comparing the calculated surface temperature with the measured surface temperature. This calculation can be carried out by referring to page 211 to 213 of "Tekkou Binran I (Steel Handbook I)(the third edition)", for example. Using knowledge for the heat transfer coefficient of the spray cooling portion such as Appendix-56 of "Solidification of Steel (1978)", the temperature of the center portion can be also obtained by combination of the calculated surface temperatures with several measured values as shown in FIG. 4.9 in page 212 of "Tekkou Binran I (Steel Handbook I)(the third edition)".

When the temperature of the cast billet center portion is obtained, the solid fraction on centerline in the portion can be obtained using the following equation. Therefore, when a computation equation (program) is available, the solid fraction on centerline can be calculated by water amounts for each spray zone, a casting speed, the thickness and the width of the cast billet, and several measured values of the surface temperature.

$$\text{the solid fraction on centerline in a cast billet}=(T1-T3)/(T1-T2) \quad (4)$$

wherein T1: liquidus temperature of cast billet

T2: solidus temperature of cast billet

T3: temperature of center portion of cast billet

The positions of the entrance and the exit of the zone of mechanical soft reduction are also instructed not only by the solid fraction on centerline as described above but also by operation parameters as follows. When the distance from the meniscus in the mold to the exit side of the zone of mechanical soft reduction along the cast billet is to be greater than "L1" represented by the following equation (2), the solid fraction on centerline in the exit side of the zone of mechanical soft reduction can be obtained the same effect as that instructed by the equation (1).

$$L1=(-1.38\times X+332.84)\times d^2\times Vc\times 10^{-6} \quad (2)$$

L1: a lower limit of the distance from the meniscus in the mold to the exit side of the zone of mechanical soft reduction along the cast billet (m)

X: the proportion of equiaxed crystals in the upper hemisection (%)

D: a thickness of billet (mm)

Vc: a casting speed (m/min)

When the distance from the meniscus in the mold to the entrance side of the zone of mechanical soft reduction along the cast billet is to be shorter than "L2" represented by the following equation (3), the same effect as the case instructed that the solid fraction on centerline necessary for preventing the flow of liquid steel is to be no more than 0.2 including some reduction by the pinch rolls.

$$L2=d^2\times Vc/4000 \quad (3)$$

The first term in the right side of the equation (2) expresses that when the proportion of equiaxed crystals is increased, the length of the exit side of the zone of mechanical soft reduction is reduced. When the proportion of equiaxed crystals is large, the flow of enriched liquid steel among solid phases is restrained to disperse the segregation even in the small solid fraction. In contrast, when the proportion of equiaxed crystals is reduced, the flow of the enriched liquid steel after leaving the zone of mechanical soft reduction becomes active, so that reduction is needed even for the portion having high solid fraction, showing that the zone of mechanical soft reduction has to be long.

The second term in the right side of the equation (2) expresses that the soft reduction on centerline is reduced in accordance with the billet thickness squared, so that the position of the zone of mechanical soft reduction is expressed to extend toward the lower course.

Furthermore, the third term in the right side expresses that the soft reduction on centerline is reduced when the casting speed is increased at the same thickness of the billet, so that the necessary position of the zone of mechanical soft reduction is expressed to extend toward the lower course.

The equation (3) expresses that the minimum length until the entrance side of mechanical soft reduction for preventing the liquid steel from accumulating in the center portion. This value is changed in proportion to the billet thickness squared and the casting speed just like in the equation (2).

The position of "L2" corresponds to the solid fractions on centerline of no less than 0.4 of the cast billet. As described above, the pinch rolls somewhat reduce the region of the solid fractions on centerline of 0.2 to 0.3 effecting the prevention of the flow of liquid steel. Furthermore, in order to control the segregation, the liquid steel in the portion of the solid fractions on centerline of over 0.4 to 0.5 in which the network is frequently formed is needed. Therefore, it is enough that the roll zone of mechanical soft reduction for reducing segregation having densely arranged rolls is arranged on the portion important for controlling the central segregation which is the lower course side than "L2", that is, the portion of the solid fractions on centerline of no less than 0.4. On the other hand, the pinch rolls reduce the region of the solid fractions on centerline of lower than 0.4 as described above.

In the above description, the effect of the case in which reduction of the size of dendritic equiaxed crystal and mechanical soft reduction are simultaneously performed is described. However, even in the case in which mechanical soft reduction is independently performed, the effect on reducing the central segregation can be realized in the following case in comparison with the case in which the mechanical soft reduction is performed without those instructions: In the case the solid fraction on centerline in the entrance side of the zone of mechanical reduction is instructed according to the equation (1). In the case the position in the exit side of the zone of mechanical reduction is instructed according to the equation (2). In the case the solid fraction on centerline in the entrance side of the zone of mechanical reduction is to be no more than 0.5 more preferably the solid fraction on centerline in the entrance side of the zone of mechanical reduction including the pinch roll zone is to be no more than 0.2. And in the case the position in the entrance side of the zone of mechanical reduction is instructed according to the equation (3).

(Embodiment)

The present invention is applied to steel billet continuous casting. The billet continuous caster for billet sizes of 120 to 140 mm square is a curved type bending at multiple points of a radius of about 5 m having a mold of a length of 800 mm in which electromagnetic stirrers for producing rotational flow of liquid steel are arranged. The curved portion in the bottom of the mold is a spray-cooling zone having no support roll. Three pairs of pinch rolls are arranged from the latter half of the curved portion to a bending back portion and the zone of mechanical reduction is included in the rear of the pinch rolls. When the mechanical soft reduction is performed, the maximum amount of reduction is to be between 15 mm and 20 mm, depending on the kind of products. The casting speed ranges from 2.5 to 3.4 m/min.

The degree of electromagnetic stirring in the mold was evaluated by the inclining angle of dendritic crystal. The inclining angle of dendritic crystal is an angle of a primary dendrite within 10 mm of a surface layer in a section perpendicular to the casting direction relative to the direction perpendicular to the surface layer.

The diameter of dendritic equiaxed crystal and the degree of segregation of the billet were evaluated by an etch print of the cast billet. A section being parallel to the casting direction of the cast billet and passing through the cast billet center as well in a range of 500 mm in the casting direction was to be an estimating surface by mirror-polishing. The surface was performed segregation etching by picric acid etchant; etched holes were filled with fine powder produced in re-polishing; and then the surface was transferred to transparent adhesive tape to be an etch print. In this etch print, the diameter of the maximum size of the dendritic equiaxed crystal existing in the cast billet center portion in the longitudinal range of 500 mm thereof was to be the diameter of the dendritic equiaxed crystal. In the same etch print, the maximum size of segregation grain in the center portion was found; the area thereof was measured; and then the diameter was calculated assuming it a circle to be the degree of segregation of the billet. Center porosities were measured in the above-mentioned section and the maximum diameter thereof was to be the center porosity diameter.

A length of rod having a diameter of 5.5 mm was produced by rod-rolling from the cast billet. The segregation was evaluated in a section of the rod parallel to the rolling direction and passing the center of the rod. The structure of the rod was evaluated by estimating the presence or absence of pro-eutectoid ferrite and micro-martensite. Wherein the degrees of segregation are defined below as:

Segregation degree "1": no strong segregation in the rod and no pro-eutectoid ferrite/micro-martensite.

Segregation degree "2": with strong segregation in the rod and pro-eutectoid ferrite/micro-martensite produced.

Segregation degree "3": with strong segregation in the rod and pro-eutectoid ferrite/micro-martensite much produced.

| | No. | Carbon content % | Billet size mm | Super heat ° C. | Stirring in mold Yes or No | Inclining angle of primary dendrite (°) | Dendritic equiaxed crystal mm | Proportion of equiaxed crystals at upper hemi-section % | Center porosity mm | Mechanical soft reduction Yes or No | Solid fraction on centerline in exit side - | Degree of segregation of billet (circle equivalent) | Degree of segregation of rod |
|---|---|---|---|---|---|---|---|---|---|---|---|---|---|
| Examples | 1 | 0.7 | 120 | 20 | Yes | 20 | 3 | 40 | 6 | No | — | 2 mm mark | 2 |
| | 2 | 0.8 | 130 | 30 | Yes | 25 | 3 | 35 | 6 | No | — | 3 mm mark | 2 |
| | 3 | 0.7 | 140 | 40 | Yes | 20 | 3.5 | 40 | 7 | No | — | 1 mm mark | 2 |
| | 4 | 0.8 | 120 | 30 | Yes | 25 | 3 | 35 | 4 | Yes | 0.6 | 2 mm mark | 1 |

-continued

| | No. | Carbon content % | Billet size mm | Super heat ° C. | Stirring in mold Yes or No | Inclining angle of primary dendrite (°) | Dendritic equiaxed crystal mm | Proportion of equiaxed crystals at upper hemi-section % | Center porosity mm | Mechanical soft reduction Yes or No | Solid fraction on centerline in exit side - | Degree of segregation of billet (circle equivalent) | Degree of segrega-tion of rod |
|---|---|---|---|---|---|---|---|---|---|---|---|---|---|
| | 5 | 0.7 | 130 | 40 | Yes | 20 | 3 | 40 | 4 | Yes | 0.7 | 1 mm mark | 1 |
| | 6 | 0.8 | 140 | 30 | Yes | 25 | 2 | 35 | 3 | Yes | 0.8 | 1 mm mark | 1 |
| | 7 | 0.8 | 140 | 40 | Yes | 15 | 6 | 35 | 4 | Yes | 0.6 | 3 mm mark | 1 |
| | 8 | 0.7 | 120 | 20 | Yes | 15 | 4 | 35 | 3 | Yes | 0.5 | 2 mm mark | 2 |
| | 9 | 0.8 | 130 | 30 | Yes | 15 | 4 | 30 | 4 | Yes | 0.4 (out of range) | 3 mm mark | 2 |
| | 10 | 0.7 | 140 | 40 | Yes | 10 | 6 | 25 | 5 | Yes | 0.6 | 3 mm mark | 1 |
| Comparative Examples | 11 | 0.8 | 120 | 20 | No | 0 | 15 | 10 | 10 | Yes | 0.7 | No less than 5 mm | 3 |
| | 12 | 0.7 | 130 | 30 | No | 0 | 15 | 25 | 11 | No | — | 4 mm mark | 3 |
| | 13 | 0.8 | 140 | 40 | No | 0 | 15 | 10 | 8 | No | — | 4 mm mark | 3 |
| | 14 | 0.7 | 120 | 20 | No | 0 | 15 | 25 | 10 | No | — | 3 mm mark | 3 |
| | 15 | 0.8 | 130 | 30 | No | 0 | 15 | 10 | 12 | No | — | Not less than 5 mm | 3 |

Liquid steel having carbon contents of 0.7 to 0.8% by mass was cast to produce a billet having a size of 120 to 140 mm square. The manufacturing conditions and results are shown in Table 1. Examples 1 to 10 are examples according to the present invention while Examples 11 to 15 are comparative examples. The super heat of liquid steel in a tundish was 20 to 40° C.

In any one of Examples 1 to 10 according to the present invention, electromagnetic stirring was performed in a mold and inclination angles of primary dendrites were 10 to 25°. In the comparative Examples 11 to 15, electromagnetic stirring was riot performed in the mold. In any one of the examples according to the present invention, granular diameters of dendritic equiaxed crystals were small of 2 to 6 mm while in the comparative examples, granular diameters of dendritic equiaxed crystals were 15 mm. As for the proportions of equiaxed crystals at the upper hemisection, in the examples according to the present invention, they were 25 to 40% while in the comparative examples, they were as lower as 10 to 25%.

In Examples 3 to 10 according to the present invention and the comparative Example 11, the mechanical soft reduction was performed: the solid fractions on a centerline in the entrance side of the zone of mechanical soft reduction were adjusted to be more or less than 0.4; the solid fraction on a centerline in the exit side of the zone of mechanical soft reduction were changed every example as shown in Table 1; and in Example 9 according to the present invention, the solid fraction on a centerline in the exit side of the zone of mechanical soft reduction is out of the range of the present invention. As for diameters of center porosities, in any of Examples in which the mechanical soft reduction was performed, the diameters were not more than 4 mm while in any of Examples in which the mechanical soft reduction was not performed, the diameters were 6 to 12 mm. It is clear that the mechanical soft reduction be effective on improving of the center porosity and the performance of the mechanical soft reduction can be confirmed if the diameter of the center porosity is not more than 4 mm. In Example 9, a zone segregated slightly appeared in the central portion; it is considered that this segregated zone is produced by the solidification of component enriched liquid steel squeezed from a solidification interface during the mechanical soft reduction after exiting the zone of mechanical soft reduction; and in Example 9, the degree of segregation was deteriorated in comparison with Examples 3 to 8 in which the mechanical soft reduction was properly performed.

As for the degrees of segregation of the billet and the rod, in any one of Examples 1 to 10 according to the present invention, the degree of segregation was improved and the degree of segregation of the rod was not more than 2; in Nos. 4 to 8 in which the mechanical soft reduction was properly performed, the degrees of segregation were further improved, so that the degree of segregation of the rod of 1 was obtained. In contrast, in any of the comparative Examples 11 to 15 in which electromagnetic stirring was not properly performed and the diameters of dendritic equiaxed crystals were out of the range according to the present invention, the degrees of segregation of the billet were not less than 3 mm and the degrees of segregation of the rod were 3 which are wrong results compared to those of the examples according to the present invention.

INDUSTRIAL APPLICABILITY

In a billet by continuous casting, the segregation in the central portion of the billet could be reduced by reduction in the size of the dendritic equiaxed crystal. For the purpose of reduction in the size of the dendritic equiaxed crystal, it was effective to increase the inclining angle of the primary dendrite in the surface layer of the billet by electromagnetic stirring in a mold. Furthermore, by performing the mechanical soft reduction during continuous casting, the central segregation could be furthermore reduced. Accordingly, the incidence of breaking of wire in wire drawing after rolling to the rod was reduced. In particular, for the high carbon steel having a carbon content of not less than 0.6%, the remarkable effect could be obtained.

Accordingly, as for the high carbon steel for the bar, simplification of the manufacturing process and promotion of energy saving could be realized in comparison with the conventional process in which the billet is produced by blooming mill from a bloom having a large cross-section cast continuously.

What is claimed is:

1. A billet produced by continuous casting, containing not less than 0.6% by mass of carbon and comprising dendritic equiaxed crystals of not larger than 6 mm in a central portion of the billet, said dendritic equiaxed crystals being achieved by horizontally stirring molten steel to be continuously cast within a mold of a continuous casting machine, wherein an inclining angle of a primary dendrite within 10 mm of a surface layer in a section perpendicular to a casting direction is not less than 15° relative to a direction perpendicular to that of the surface layer.

2. A billet according to claim 1, wherein the proportion of the dendritic equiaxed crystals at an upper hemisection of the billet is not less than 30%.

3. A billet according to claim 1 or 2, wherein a center porosity in the central portion of the billet has a diameter not larger than 4 mm.

* * * * *